US009147966B2

(12) United States Patent
An

(10) Patent No.: US 9,147,966 B2
(45) Date of Patent: Sep. 29, 2015

(54) CASE FOR A PORTABLE ELECTRONIC DEVICE HAVING A NON-INSERTION TYPE INTERFACE

(71) Applicant: DAE HAN SPECIAL METAL IND CO., LTD., Incheon (KR)

(72) Inventor: Joon-Bum An, Bucheon-si (KR)

(73) Assignee: DAE HAN SPECIAL METAL IND CO., LTD. (KR)

( * ) Notice: Subject to any disclaimer, the term of this patent is extended or adjusted under 35 U.S.C. 154(b) by 0 days.

(21) Appl. No.: 14/342,853

(22) PCT Filed: Feb. 18, 2013

(86) PCT No.: PCT/KR2013/001225
§ 371 (c)(1),
(2) Date: Mar. 5, 2014

(87) PCT Pub. No.: WO2013/129794
PCT Pub. Date: Sep. 6, 2013

(65) Prior Publication Data

US 2014/0362587 A1 Dec. 11, 2014

(30) Foreign Application Priority Data

Feb. 27, 2012 (KR) ..... 10-2012-0019725

(51) Int. Cl.
*H01R 13/62* (2006.01)
*H01R 11/30* (2006.01)
(Continued)

(52) U.S. Cl.
CPC ..... *H01R 13/6205* (2013.01); *A45C 11/00* (2013.01); *F21K 9/50* (2013.01); *H01R 11/30* (2013.01); *A45C 2011/002* (2013.01); *H01R 13/2414* (2013.01)

(58) Field of Classification Search
CPC ..... H01R 11/30
USPC ..... 439/38, 300, 305
See application file for complete search history.

(56) References Cited

U.S. PATENT DOCUMENTS 6,623,276 B2 * 9/2003 Dalmau Ferrerfabrega et al. ..... 439/39
6,727,477 B1 * 4/2004 Li-Chen ..... 219/494
(Continued)

FOREIGN PATENT DOCUMENTS

KR 200133713 10/1998
KR 200265673 2/2002
(Continued)

OTHER PUBLICATIONS

International Search Report—PCT/KR2013/001225 dated Jun. 28, 2013.

*Primary Examiner* — Chandrika Prasad
(74) *Attorney, Agent, or Firm* — Cantor Colburn LLP

(57) ABSTRACT

Provided is a case for a portable electronic device, including: a body in which the portable electronic device is accommodated; and a non-insertion type interface including an insertion type connector that is formed on an inner side of the body and that is inserted into an open type port formed at the portable electronic device and a non-insertion type port that is formed on an outer side of the body opposite to the side on which the insertion type connector is formed so as to be electrically connected to the insertion type connector and that causes a non-insertion type connector of a peripheral device to come into surface contact with the non-insertion type port using magnetism.

7 Claims, 6 Drawing Sheets

(51) Int. Cl.

| | |
|---|---|
| ***A45C 11/00*** | (2006.01) |
| ***F21K 99/00*** | (2010.01) |
| *H01R 13/24* | (2006.01) |

(56) References Cited

U.S. PATENT DOCUMENTS

| | | | | |
|---|---|---|---|---|
| 7,517,222 | B2 * | 4/2009 | Rohrbach et al. | 439/39 |
| 7,625,212 | B2 * | 12/2009 | Du | 439/39 |
| 7,641,477 | B2 * | 1/2010 | DiFonzo et al. | 439/39 |
| 8,920,178 | B2 * | 12/2014 | Wei et al. | 439/38 |
| 2007/0072443 | A1 * | 3/2007 | Rohrbach et al. | 439/39 |
| 2007/0287302 | A1 * | 12/2007 | Lindberg et al. | 439/38 |
| 2014/0363988 | A1 * | 12/2014 | An | 439/39 |
| 2015/0081944 | A1 * | 3/2015 | An | 710/300 |

FOREIGN PATENT DOCUMENTS

| | | |
|---|---|---|
| KR | 1020020080766 | 10/2002 |
| KR | 200382247 | 4/2005 |

* cited by examiner

CASE FOR A PORTABLE ELECTRONIC DEVICE HAVING A NON-INSERTION TYPE INTERFACE

TECHNICAL FIELD

The present invention relates to a case for a portable electronic device, and more particularly, to a case for a portable electronic device having a non-insertion type interface, whereby the case protects an outer side of the portable electronic device, an insertion type connector is inserted into an open type port of the portable electronic device and a non-insertion type connector for a peripheral device that corresponds to the insertion type connector comes into non-insertion point contact with a non-insertion type port using magnetism.

BACKGROUND ART

In general, portable electronic devices, such as mobile phones, smartphones, or tablet personal computers (PCs), have been necessarily used for communication in a modern society. Various units for protecting these portable electronic devices have been researched and developed due to their high prices and outer surface special processing thereof. In particular, various types of cases, whereby a crack or scratch can be prevented from occurring due to contact between sides, rear surfaces, and edges of the portable electronic devices and other objects when the portable electronic devices are carried, or partial abrasion can be prevented from occurring due to user's hand grasp, the portable electronic devices are accommodated so as to protect various manipulation buttons or keys and exteriors of the portable electronic devices are protected, have been suggested.

Meanwhile, the portable electronic devices each include an open type port that enables connection of a connector of a peripheral device, such as a charging unit, to sides of the portable electronic device and charging of the portable electronic devices. Since the case has a through hole formed therein so that an insertion type connector of the peripheral device can be connected to the open type port through the through hole, a contact point terminal of the insertion type connector of the peripheral device physically comes into contact with a contact point terminal of the open type port such that the use, i.e., charging of the peripheral device can be performed.

However, since the open type port of the portable electronic device generally has a structure of a concave groove shape and the insertion type connector of the peripheral device generally has a structure of a convex protrusion shape, damage or breakage in which physical contact point states of connectors become loose with reciprocal repeated combination and separation, a contact state of the contact point terminals becomes bad, or contact point terminals of the connectors may be bent or crooked according to a separation direction when the connectors are separated from each other.

Also, when the open type port and the insertion type connector are coupled to each other in a reverse direction or an unreasonable force is applied to the open type port and the insertion type connector with a wrong using method, a printed circuit board (PCB) connected to the contact point terminal may be damaged with damage of the contact point terminal, and in this case, an economical loss in which the PCB needs to be replaced with a new one, may occur.

Furthermore, since the open type port has always an open state, when foreign substances, such as dust and water, are introduced into the open type port, an unstable connection state may be established, and esthetic appeal of the portable electronic device may be lowered.

DETAILED DESCRIPTION OF THE INVENTION

Technical Problem

The present invention provides a case for a portable electronic device having a non-insertion type interface, whereby the case protects an outer side of the portable electronic device, an insertion type connector is inserted into an open type port of the portable electronic device and a non-insertion type connector for a peripheral device that corresponds to the insertion type connector comes into non-insertion contact with a non-insertion type port using magnetism.

Technical Solution

According to an aspect of the present invention, there is provided a case for a portable electronic device, including: a body in which the portable electronic device is accommodated; and a non-insertion type interface including an insertion type connector that is formed on an inner side of the body and that is inserted into an open type port formed at the portable electronic device and a non-insertion type port that is formed on an outer side of the body opposite to the side on which the insertion type connector is formed so as to be electrically connected to the insertion type connector and that causes a non-insertion type connector of a peripheral device to come into surface contact with the non-insertion type port using magnetism.

The non-insertion type port may include: at least one magnetic coupling member that is formed on a contact surface of the non-insertion type interface and comes into surface contact with at least one magnetic coupling member provided on a contact surface of the non-insertion type connector using magnetism; and at least one contact terminal that is formed on the contact surface and causes at least one contact terminal of the non-insertion type connector to come into non-insertion point contact with the contact terminal when the magnetic coupling members are combined with each other using magnetism.

The non-insertion type port may further include at least one guide that is formed on the contact surface and guides a guide of the non-insertion type connector so that non-insertion point contact of the contact terminals can be precisely performed in accordance with a magnetism combination of the magnetic coupling members.

BEST MODE OF THE INVENTION

Hereinafter, the present invention will be described in detail by explaining exemplary embodiments of the invention with reference to the attached drawings.

Figure 1:
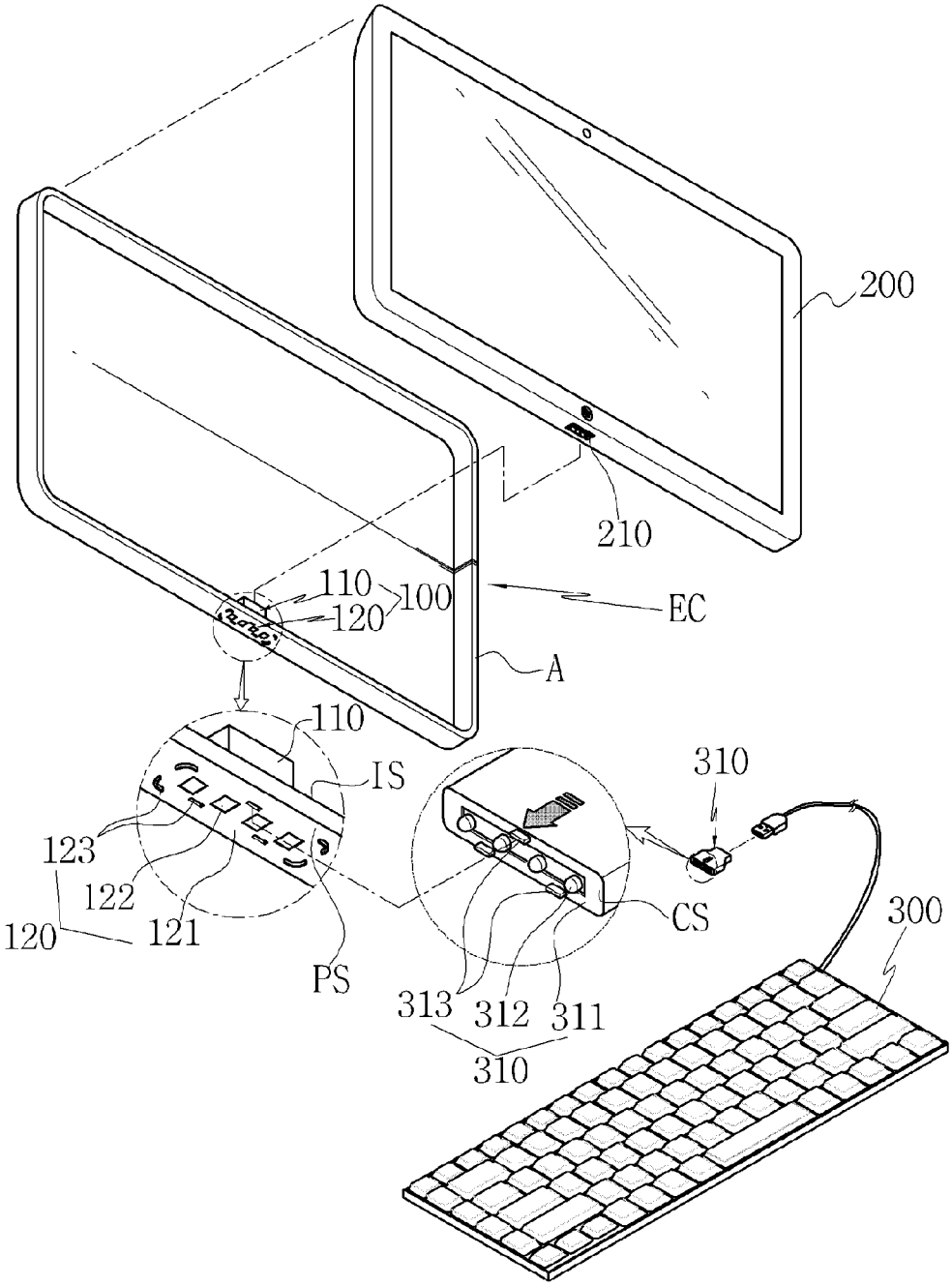
FIG. 1 is a perspective view of a case for a portable electronic device having a non-insertion type interface according to an exemplary embodiment of the present invention.
Figure 2:
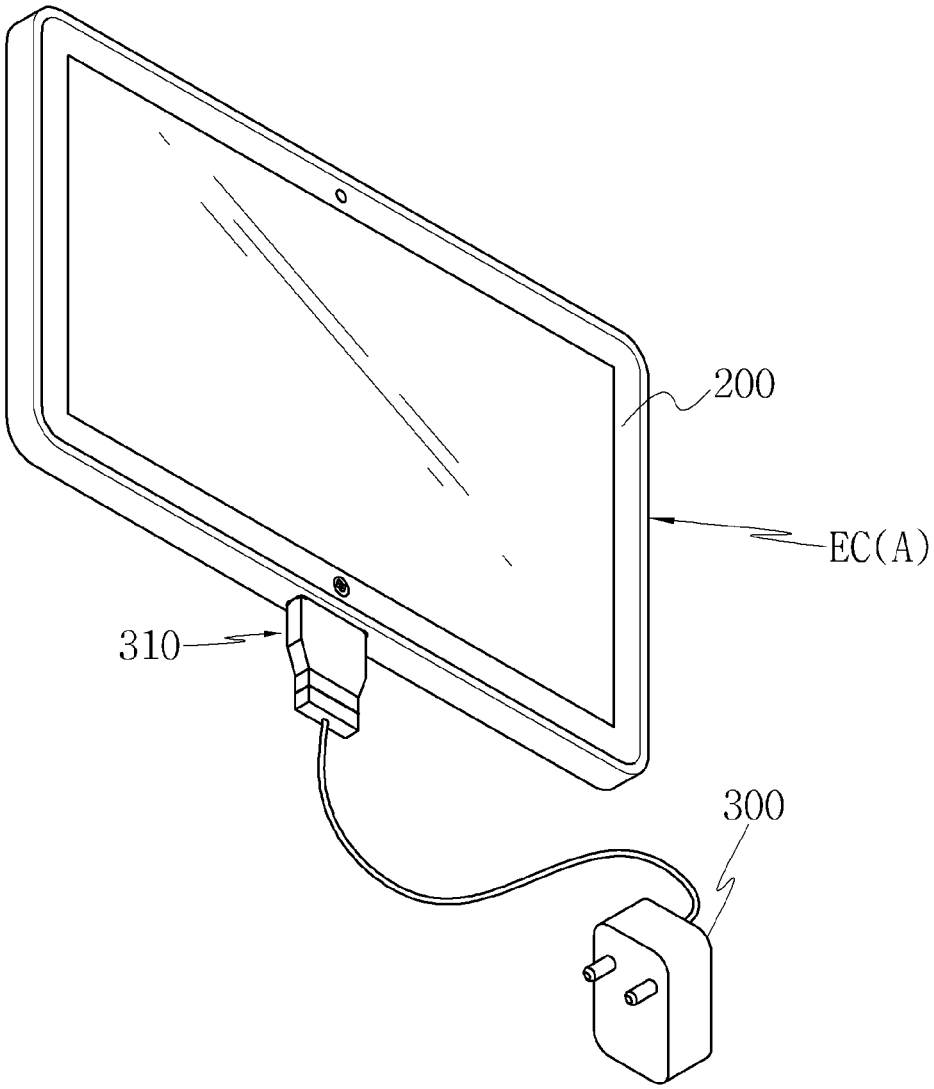
FIG. 2 illustrates a state in which a non-insertion type connector of a peripheral device comes in contact with a non-insertion type port of the non-insertion type interface illustrated in FIG. 1.
Figure 3A:
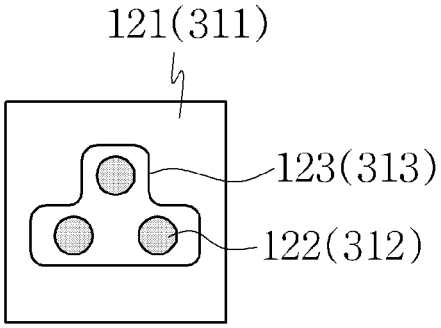
FIGS. 3A through 3G illustrate the non-insertion type port of the non-insertion type interface of FIG. 1 and the non-insertion type connector of the peripheral device, according to various embodiments of the present invention.
Figure 3B:
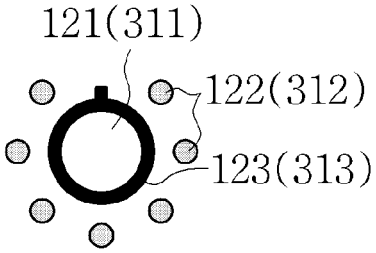
Figure 3C:
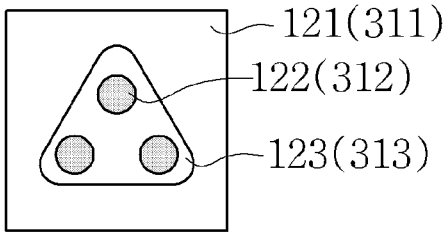
Figure 3D:
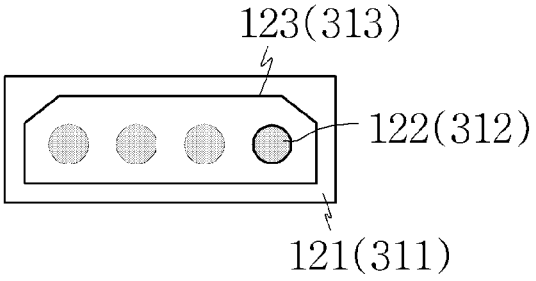
Figure 3E:
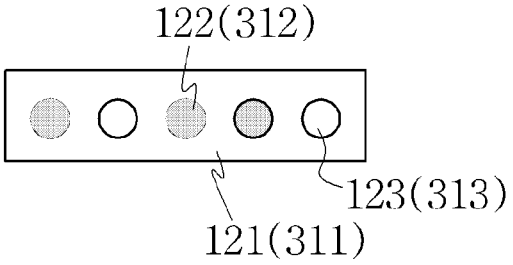
Figure 3F:
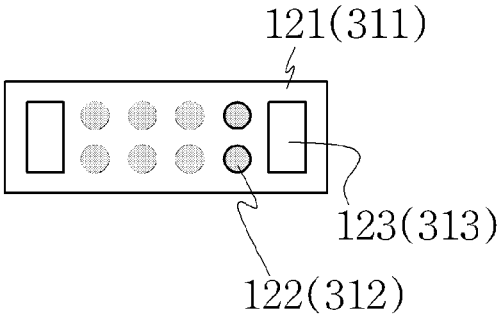
Figure 3G:
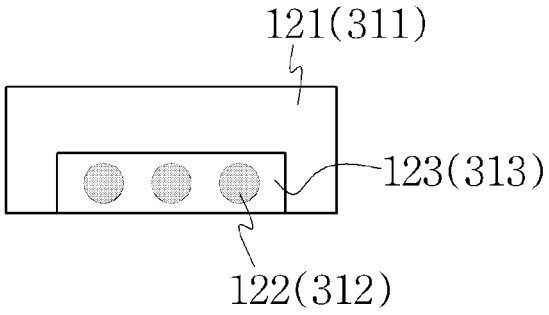
Figure 4A:
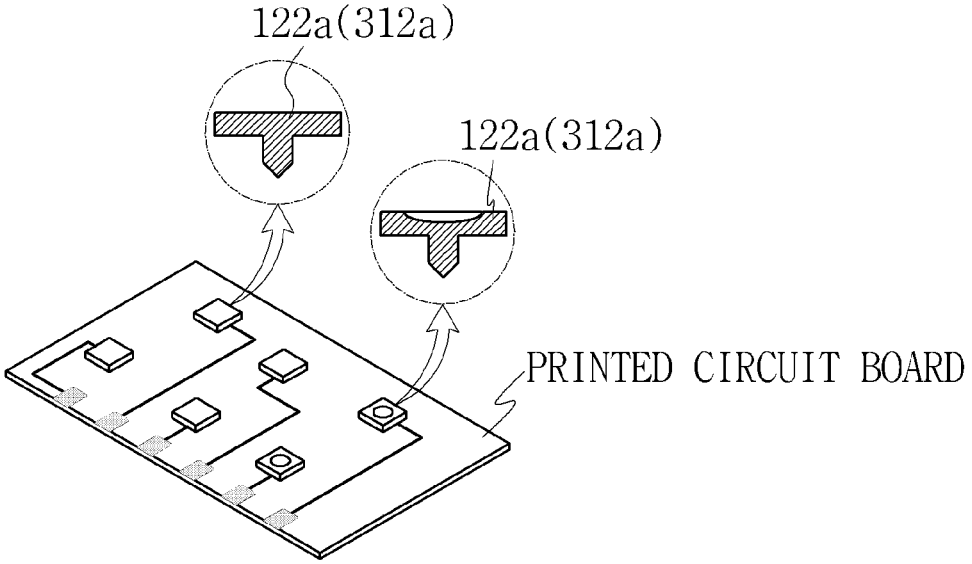
FIGS. 4A through 4C illustrate a contact terminal provided on a printed circuit board (PCB) of the non-insertion type port and the non-insertion type connector illustrated in FIGS. 3A through 3G, according to an embodiment of the present invention.
Figure 4B:
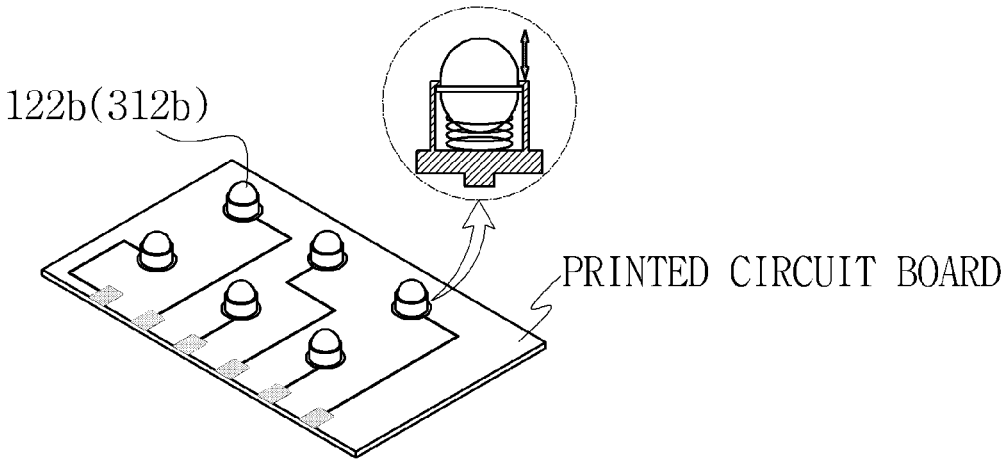
Figure 4C:
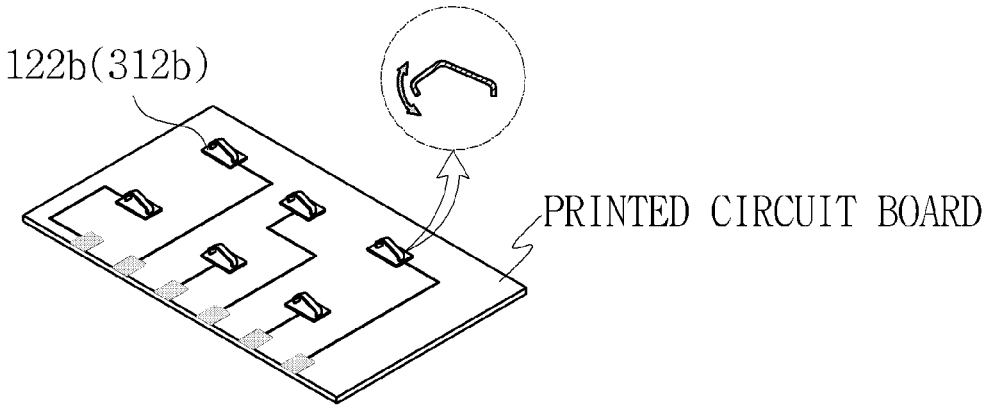

FIG. 1 is a perspective view of a case for a portable electronic device having a non-insertion type interface according to an exemplary embodiment of the present invention, FIG. 2 illustrates a state in which a non-insertion type connector of a peripheral device comes in contact with a non-insertion type port of the non-insertion type interface illustrated in FIG. 1, FIGS. 3A through 3G illustrate the non-insertion type port of the non-insertion type interface of FIG. 1 and the non-insertion type connector of the peripheral device, according to various embodiments of the present invention, and FIGS. 4A through 4C illustrate a contact terminal provided on a printed circuit board (PCB) of the non-insertion type port and the non-insertion type connector illustrated in FIGS. 3A through 3G, according to an embodiment of the present invention.

As illustrated in FIGS. 1 through 4, a case EC for a portable electronic device having a non-insertion type interface according to an exemplary embodiment of the present invention includes a body A having a shape corresponding to an exterior of a portable electronic device 200 other than a display unit of the portable electronic device 200 so as to cover and protect the exterior of the portable electronic device 200, and a non-insertion type interface 100 including an insertion type connector 110 that is formed on an inner side of the body A, i.e., a lower side of the body A and that is inserted into an open type port 210 formed at the portable electronic device 200 and a non-insertion type port 120 that is formed on outer side of the body A opposite to the side on which the insertion type connector 110 is formed, that is electrically connected to the insertion type connector 110 and that causes a non-insertion type connector 310 of a peripheral device 300 to come into surface contact with the non-insertion type port 120 using magnetism.

That is, the non-insertion type interface 100 of the case EC according to the present invention enables sealing of an open portion of the open type port 210 of the portable electronic device 200 using the insertion type connector 110 and sealing of the open portion using the non-insertion type port 120 connected to the insertion type connector 110 so that a problem that may occur when the open type port 210 has an open shape can be prevented.

Also, in the non-insertion type interface 100 of the case EC, the non-insertion type connector 310 of the peripheral device 300 comes into contact with the non-insertion type port 120 using magnetism so that a conventional problem that may occur when the non-insertion type connector 310 having a protrusion shape of the peripheral device 300 is inserted into and comes into contact with the non-insertion type port 120 can be prevented.

Hereinafter, the case EC for the portable electronic device 200 having the non-insertion type interface 100 illustrated in FIG. 1 will be described in more detail.

The body A may have a shape in which the body A may cover an exterior (except for the display unit) of the portable electronic device 200, such as a mobile phone, a smartphone, or a tablet personal computer (PC). The body A may be configured using various structures and assembling methods, whereby the body A is formed of a flexible material or causes a plurality of pieces to be connected as one body via a connection member and enables easy electrical point contact between the insertion type connector 110 of the non-insertion type interface 100 and the open type port 210 of the portable electronic device 200.

Here, the body A may serve as a bumper that protects the portable electronic device 200 from a shock. A lighting member, such as a plurality of light emitting diode (LED) lamps that are connected to the insertion type connector 110 that will be described later and that emit light with power supplied from the portable electronic device 200, and a lighting diffusion member may be further provided at the body A so that the body A serves as a delicate lighting when the insertion type connector 110 is connected to the open type port 210 of the portable electronic device 200. Also, the body A may further include accessories of various colors so that esthetic appeal of the portable electronic device 200 can be improved.

The insertion type connector 110 is formed on an inner side of the body A, i.e., an insertion surface IS, to correspond to the open type port 210 of the portable electronic device 200 and thus is inserted into and connected to the open type port 210. When the open type port 210 has the same shape as that of a charging port, the case EC includes a connector having a shape in which the insertion type connector 110 is to be inserted into the port.

Here, structures of the insertion type connector 110 and the open type port 210 are well-known to one of ordinary skill in the art and thus a detailed description thereof will be omitted.

The non-insertion type port 120 is a connection port that is formed on an outer side opposite to the side on which the insertion type connector 110 is formed, i.e., a contact surface PS, to electrically correspond to the insertion type connector 110, that is provided to communicate with each other and that causes the non-insertion type connector 310 of the peripheral device 300 to come into surface contact with the non-insertion type port 120 using magnetism. The non-insertion type port 120 includes a magnetic coupling member 121 that is formed on the contact surface PS of the non-insertion type interface 100 and comes into surface contact with a magnetic coupling member 311 provided on a contact surface CS of the non-insertion type connector 310 using magnetism, a contact terminal 122 that is formed on the contact surface PS and causes a contact terminal 312 of the non-insertion type connector 310 to come into non-insertion point contact with the contact terminal 122 when a magnetism combination of the magnetic coupling members 121 and 311 is performed, thereby enabling reciprocal transmission of power and data, and a guide 123 that is formed on the contact surface PS and causes a guide 313 of the non-insertion type connector 310 to be guided so that non-insertion point-contact of the contact terminals 122 and 312 with a magnetism combination of the magnetic coupling members 121 and 311 can be precisely performed.

Here, the non-insertion type connector 310 of the peripheral device 300 connected to the non-insertion type port 120 of the non-insertion type interface 100 of the case EC is a connector that causes the non-insertion type connector 310 to come into surface contact with the non-insertion type port 120 using magnetism. The non-insertion type connector 310 of the peripheral device 300 includes a magnetic coupling member 311 that is formed on the contact surface CS of a connector case C and is coupled to the magnetic coupling member 121 using magnetism, a contact terminal 312 that is formed on the contact surface CS and causes the contact terminal 122 to come into non-insertion point contact with the contact terminal 312 when a magnetism combination of the magnetic coupling members 121 and 311 is performed, thereby enabling reciprocal transmission of power and data, and the guide 313 that is formed on the contact surface CS and is guided by the guide 123 so that non-insertion point-contact of the contact terminals 122 and 312 with a magnetism combination of the magnetic coupling members 121 and 311 can be precisely performed.

The magnetic coupling member 121 is a coupling member that is formed on the contact surface PS of the body A and comes into surface contact with and is coupled to the magnetic coupling member 311 provided on the contact surface CS of the non-insertion type connector 310 using magnetism. The magnetic coupling member 121 may be placed on the contact surface PS of the body A to have various shapes and areas. For example, the magnetic coupling member 121 may be provided to have an area corresponding to an area of the contact surface PS other than the contact terminal 122 and the guide 123, as illustrated in FIGS. 3A through 3G, or may be provided at one side of the contact terminal 122 and the guide 123 to have the area, or may be integrally formed with the guide 123.

Here, the magnetic coupling member 121 may be configured as one of a magnetic member and a magnetized member. When the magnetic coupling member 121 is a magnetic member, the magnetic coupling member 121 may be at least one of a magnet, an electromagnet, a permanent magnet, a monopole magnetizer, an a multi-pole magnetizer. When the magnetic coupling member 121 is a magnetized member, the magnetic coupling member 121 may include a metal or ferromagnetic substance that may be combined with the magnetic member using magnetism.

Thus, when the magnetic coupling member 311 of the non-insertion type connector 310 of the peripheral device 300 is a magnetic member, the magnetic coupling member 121 may be a magnetic member having attraction with respect to the magnetic member so that the magnetic coupling member 121 and the magnetic coupling member 311 can be combined with each other using reciprocal magnetism, or a magnetized member. When the magnetic coupling member 311 is a magnetized member, the magnetic coupling member 121 may be a magnetic member so that the magnetic coupling member 121 and the magnetic coupling member 311 can be combined with each other using reciprocal magnetism.

Meanwhile, when the magnetic coupling members 121 and 311 are magnets, the magnets are manufactured as vertical monopole, two-pole and four-pole magnetizers using equipment called a 'magnetizing yoke' without physically dividing the magnets and may have various numbers of polarities, or a metal substance may be placed at at least one of a rear portion, a right and left side portion, and a vertical side portion of each of the magnets so that magnetism can be improved using securing linearity of magnetism, or when a magnetism combination of the magnets is performed, only corresponding polarities of the magnets are combined so that, when the non-insertion type port 120 and the non-insertion type connector 310 need to come into point contact with each other with directivity, point contact in a reverse direction can be prevented.

Thus, according to the magnetic coupling member 121 of the non-insertion type port 120, when the contact surface CS of the non-insertion type connector 310 comes into surface contact with the contact surface PS of the body A, the magnetic coupling member 311 may be coupled to the magnetic coupling member 121 using magnetism.

The contact terminal 122 may be integrally formed on a PCB provided at an inner side of the contact surface PS using a plating method or mounted on the PCB using a shape of a pin.

Here, the contact terminal 122 having various numbers may be disposed on the contact surface PS of the body A, as illustrated in FIGS. 3A through 3G. Also, as illustrated in FIGS. 4A through 4C, the contact terminal 122 may include a planar terminal 122*a*, of which an end has a planar or concave groove, and an elastic terminal 122*b*, of which an end rebounds and is inserted into the PCB with elasticity of a spring provided inside the elastic terminal 122*b* or only the end bends toward the PCB with elasticity. The planar terminal 122*a* has a structure in which the planar terminal 122*a* is recessed into an inner side of a through hole formed in the contact surface PS or corresponds to a plane of the through hole, and the elastic terminal 122*b* has a structure in which a part of the elastic terminal 122*b* protrudes toward an outer side of the through hole formed in the contact surface PS.

Thus, the contact terminal 122 may be the elastic terminal 122*b* that enables reciprocal electrical point contact when the contact terminal 312 of the non-insertion type connector 310 of the peripheral device 300 is a planar terminal 312*a*. When the contact terminal 312 is an elastic terminal 312*b*, the contact terminal 122 may be the planar terminal 122*a* that enables reciprocal electrical point contact.

Thus, according to the contact terminal 122 of the non-insertion type port 120, the contact surface CS of the non-insertion type connector 310 elastically comes into point contact with the contact surface PS of the body A when the magnetic coupling members 121 and 311 for surface contact are combined with each other using magnetism, thereby enabling transmission of power and data between the non-insertion type port 120 and the non-insertion type connector 310.

In this case, the PCB on which the contact terminal 122 of the non-insertion type port 120 is placed, may be electrically connected to the PCB of the insertion type connector 110. Thus, when the insertion type connector 110 is inserted into the open type port 210 of the portable electronic device 200, power and data can be transmitted.

Meanwhile, the contact terminal 122 may be formed on the PCB using various methods including assembling a material to which an electric current may be applied, i.e., the pin or an iron piece that is processed by etching and pressing, as well as the contact terminal 122 being integrally formed when a plating procedure for manufacturing the PCB is performed.

The guide 123 is a guide member that guides the guide 313 of the non-insertion type connector 310 so that, when the non-insertion type connector 310 comes into surface contact with the contact surface PS, the guide 123 can be formed on the contact surface PS and non-insertion point contact between the contact terminals 122 and 312 with a magnetism combination of the magnetic coupling members 121 and 311 can be precisely performed as intended. The guide 123 may be placed on the contact surface PS of the body A to have various shapes and areas. For example, as illustrated in FIGS. 3A through 3G, the guide 123 may be formed to cover a plurality of contact terminals 122 with one group, or to include the magnetic coupling member 121 in a position of the contact surface PS, or one or a plurality of contact terminals 122 may be independently performed in the position of the contact surface PS.

Here, the guide 123 may be formed as one of an embossed guide that protrudes from the contact surface PS and an intagliated guide that is recessed into the contact surface PS. When the guide 313 of the non-insertion type connector 310 of the peripheral device 300 is an embossed guide, the guide 123 may be formed as an intagliated guide so that reciprocal insertion and combination can be performed. When the guide 313 of the non-insertion type connector 310 is an intagliated guide, the guide 123 may be formed as an embossed guide so that reciprocal insertion and combination can be performed. Thus, when the non-insertion type port 120 and the non-insertion type connector 310 need to come into point contact with each other with directivity, point contact in a reverse direction can also be prevented.

Thus, the guide 123 of the non-insertion type port 120 guides the guide 313 of the non-insertion type connector 310 so that, when the non-insertion type connector 310 comes into surface contact with the contact surface PS, non-insertion point contact between the contact terminals 122 and 312 with a magnetism combination of the magnetic coupling members 121 and 311 can be precisely performed as intended. Thus, the non-insertion type connector 310 can be prevented from being unintentionally separated from a contact portion and simultaneously, the contact terminals 122 and 312 can be prevented from coming into point contact with each other in the reverse direction according to shapes.

Meanwhile, the guide 123 may also be provided on the contact surface PS to correspond to the exterior of the connector case C on the contact surface CS of the non-insertion type connector 310. Thus, the contact surface CS of the non-insertion type connector 310 may be precisely placed on the contact surface PS of the non-insertion type port 120.

Thus, according to the non-insertion type port 120, the non-insertion type connector 310 of the peripheral device 300 is guided toward the non-insertion type port 120, comes into surface contact with the non-insertion type port 120 using magnetism and simultaneously, non-insertion point contact between the contact terminals 122 and 312 is performed. Thus, the non-insertion type port 120 can be easily connected to or separated from the non-insertion type connector 310, and unstable connection of terminals and damage of components that are conventional problems can be prevented.

Meanwhile, the non-insertion type connector 310 for the peripheral device 300 connected to the non-insertion type interface 100 of the case EC illustrated in FIG. 1 includes the magnetic coupling member 311, the contact terminal 312, and the guide 313 that are formed on the contact surface CS of the connector case C, as described above. Each magnetic member or magnetized member, the planar terminal 312*a*, the elastic terminal 312*b*, the embossed guide, and the intagliated guide are configured in the same structures and the same methods as those of the magnetic member or magnetized member, the planar terminal 122*a*, the elastic terminal 122*b*, the embossed guide, and the intagliated guide of the non-insertion type port 120.

Thus, the magnetic coupling member 311, the contact terminal 312, and the guide 313 formed on the contact surface CS of the connector case C, and the magnetic coupling member 121, the contact terminal 122, and the guide 123 of the non-insertion type port 120 are configured so that their reciprocal opposed configurations, i.e., a magnetic member and a magnetized member, a planar terminal and an elastic terminal, and an embossed guide and an intagliated guide may correspond to each one configuration. Thus, the non-insertion type port 120 and the non-insertion type connector 310 may face each other and may be coupled to each other so that transmission of power and data between the peripheral device 300 and the portable electronic device 200 can be performed.

In this case, the magnetic coupling members 121 and 311 may be provided at both or either of the non-insertion type port 120 and the non-insertion type connector 310.

Also, the non-insertion type connector 310 may be configured as a gender type that is separately connected to a terminal of an existing connector of the peripheral device 300 or an integral type that is connected directly to an end of an electric wire of the peripheral device 300 instead of the existing connector. When the non-insertion type connector 310 is formed as the gender type, the non-insertion type connector 310 may be configured in various shapes in which an existing terminal is fully accommodated and covered or is inserted into a rear side of the connector case C. The gender type non-insertion type connector 310 may be connected to the connector case C via a loss prevention unit, such as a loop that is provided at the electric wire of the peripheral device 300 so as to prevent loss.

Meanwhile, in the present invention, when the non-insertion type connector 310 comes into surface contact with the non-insertion type port 120, contact surfaces are guided by the guides 123 and 313. However, it is obvious to one of ordinary skill in the art that the above-described function may be performed through embossing and intaglio operations of the magnetic coupling members 121 and 311. Thus, a detailed description thereof will be omitted.

Hereinafter, operations and effects of the case EC for the portable electronic device 200 having the non-insertion type interface 100 and the non-insertion type connector 310 of the peripheral device 300 connected to the case EC illustrated in FIG. 1 will be described.

First, the portable electronic device 200 is accommodated in the body A of the case EC so that the insertion type connector 110 of the non-insertion type interface 100 is inserted into and connected to the open type port 210 formed at the portable electronic device 200.

Thus, the portable electronic device 200 can be carried in a state in which the case EC accommodates the portable electronic device 200. Also, compared to the open type port 210 formed at the portable electronic device 200, the non-insertion type port 120 formed on the contact surface PS of the body A to correspond to the open type port 210 may be placed with a sense of sealing so that foreign substances can be prevented from being inserted into the non-insertion type port 120 and esthetic appeal of the portable electronic device 200 can be improved.

In this state, when the peripheral device 300 is used, the non-insertion type connector 310 of the peripheral device 300 comes into surface contact with the non-insertion type port 120 of the non-insertion type interface 100 placed on the contact surface PS of the body A.

In this case, the magnetic coupling members 121 and 311 configured by being guided by the guide 123 of the non-insertion type port 120 are combined with each other using magnetism and thus, the contact terminals 122 and 312 configured on the magnetic coupling members 121 and 311 come into electrical point contact with each other so that the guide 313 of the non-insertion type connector 310 enables easy connection and separation to and from the non-insertion type connector 310 and thus a conventional problem that may occur when contact terminals are in an unstable connection state due to a long usage can be prevented.

Thus, according to the present invention described above, a non-insertion type connector of a peripheral device comes into non-insertion point contact with a non-insertion type port of a non-insertion type interface using magnetism in a state in which a portable electronic device is accommodated in a body of a case so that a non-insertion type interface insertion type connector can be inserted into and connected to an open type port of the portable electronic device so that connection of the peripheral device to the portable electronic device can be more conveniently and solidly performed and a stable contact state can be maintained.

Also, the portable electronic device can be carried in a state in which it is accommodated in the case so that esthetic appeal of the portable electronic device can be improved and simultaneously foreign substances can be prevented from being inserted into the open type port and the portable electronic device can be protected from an external shock.

While the present invention has been particularly shown and described with reference to exemplary embodiments thereof, it will be understood by those of ordinary skill in the art that various changes in form and details may be made therein without departing from the spirit and scope of the present invention as defined by the following claims.

INDUSTRIAL APPLICABILITY

According to the present invention, a non-insertion type connector of a peripheral device comes into non-insertion point contact with a non-insertion type port of a non-insertion type interface using magnetism in a state in which a portable electronic device is accommodated in a body of a case so that a non-insertion type interface insertion type connector can be inserted into and connected to an open type port of the portable electronic device so that connection of the peripheral device to the portable electronic device can be more conveniently and solidly performed and a stable contact state can be maintained.

Also, the portable electronic device can be carried in a state in which it is accommodated in the case so that esthetic appeal of the portable electronic device can be improved and simultaneously foreign substances can be prevented from being inserted into the open type port and the portable electronic device can be protected from an external shock.

The invention claimed is:

1. A case for a portable electronic device, comprising:

a body configured to accommodate the portable electronic device having an open type port; and a non-insertion type interface formed in the body at a position corresponding to the open type port, wherein the non-insertion type interface comprises: an insertion type connector that is formed on an inner side of the body and configured to be inserted into the open type port; and a non-insertion type port that is formed on an outer side of the body opposite to the side on which the insertion type connector is formed and electrically connected to the insertion type connector; and wherein the non-insertion type port is configured to come into surface contact with a non-insertion type connector of a peripheral device using magnetism.

2. The case for a portable electronic device of claim 1, wherein the non-insertion type port comprises:

at least one first magnetic coupling member that is formed on a first contact surface of the non-insertion type interface and configured to come into surface contact with at least one second magnetic coupling member provided on a second contact surface of the non-insertion type connector; and at least one first contact terminal that is formed on the first contact surface and configured to come into non-insertion point contact with at least one second contact terminal of the non-insertion type connector when the first and second magnetic coupling members are combined with each other.

3. The case for a portable electronic device of claim 2, wherein the non-insertion type port further comprises at least one first guide that is formed on the first contact surface and configured to guide at least one second guide of the non-insertion type connector so that the non-insertion point contact of the first and second contact terminals is capable of being precisely performed.

4. The case for a portable electronic device of claim 2, wherein the first magnetic coupling member includes one of a magnetic member and a magnetized member, and wherein the magnetic member comprises at least one of a magnet, an electromagnet, a permanent magnet, a monopole magnetizer, and a multi-pole magnetizer, and the magnetized member comprises a metal or a ferromagnetic substance.

5. The case for a portable electronic device of claim 2, wherein the first contact terminal includes one of a planar terminal, of which an end has a planar or concave groove, and an elastic terminal, of which an end has elasticity of a spring provided inside the elastic terminal or only the end bends toward a PCB with elasticity, and wherein the planar terminal has a structure in which the planar terminal is recessed into an inner side of a through hole formed in the first contact surface or corresponds to a plane of the through hole, and the elastic terminal has a structure in which a part of the elastic terminal protrudes toward an outer side of the through hole formed in the first contact surface.

6. The case for a portable electronic device of claim 3, wherein the first guide is formed as one of an embossed guide that protrudes from the first contact surface and an intagliated guide that is recessed into the first contact surface.

7. The case for a portable electronic device of claim 1, wherein a lighting member and a lighting diffusion member are further provided at the body.

* * * * *